US006516792B1

(12) United States Patent
McDonald

(10) Patent No.: US 6,516,792 B1
(45) Date of Patent: Feb. 11, 2003

(54) COMPACT MULTIPURPOSE OUTDOOR COOKING APPARATUS

(76) Inventor: Warren Dean McDonald, 11484 56th St., NE., Albertville, MN (US) 55301

( * ) Notice: Subject to any disclaimer, the term of this patent is extended or adjusted under 35 U.S.C. 154(b) by 50 days.

(21) Appl. No.: 09/907,342

(22) Filed: Jul. 17, 2001

(51) Int. Cl.[7] ..... F24C 1/16; F24B 3/00

(52) U.S. Cl. ..... 126/9 R; 126/25 A; 126/25 AA; 126/30

(58) Field of Search ..... 126/9 R, 9 B, 126/25 A, 25 AA, 30, 40, 51, 50, 29, 25 R; 99/448, 402, 393, 395, 444

(56) References Cited

U.S. PATENT DOCUMENTS

| | | | | |
|---|---|---|---|---|
| 955,140 A | * | 4/1910 | Cronk | 126/30 |
| 3,094,113 A | * | 6/1963 | Avila | 126/9 R |
| 3,617,022 A | * | 11/1971 | Wiggins | 126/25 A |
| 4,630,593 A | * | 12/1986 | Gremillion | 126/9 R |
| 5,282,458 A | * | 2/1994 | Trimble | 126/373.1 |
| 5,720,272 A | * | 2/1998 | Chiang | 126/9 R |

FOREIGN PATENT DOCUMENTS

| | | | |
|---|---|---|---|
| DE | 296 11 874 U1 | * | 7/1996 |
| FR | 2 560 030 A1 | * | 8/1985 |

* cited by examiner

*Primary Examiner*—Henry Bennett
*Assistant Examiner*—Josiah C. Cocks
(74) *Attorney, Agent, or Firm*—Michael A. Mochinski

(57) ABSTRACT

A compact multipurpose, multi-component cooking apparatus adaptable for use in an outdoor environment, the cooking apparatus comprising an annular ring, a basin having a flange to mate and engage with the annular ring, a cooking surface suspended from within the basin, a grate suspended in the lower portion of the basin for supporting wood, charcoal and the like; at least three adjustable legs threadly attached to the annular ring; a dome-shaped cover having a rim extending outwardly therefrom to mate with the flange extending from the basin; a turbine to rotate a cooking surface about a heat source to uniformly heat and cook foods and the like residing atop of the cooking surface; and a common linear support having a first end engaged to an elongate handle fixedly attached to the dome-shaped cover and a second end to serve as a common point for connecting at least three linear members which serve to suspend the cooking surface, grate or turbine above the heat source.

22 Claims, 17 Drawing Sheets

COMPACT MULTIPURPOSE OUTDOOR COOKING APPARATUS

FIELD OF THE INVENTION

The present invention relates to a multi-purpose, multi-component cooking apparatus for use in outdoor environments. More particularly, the present invention relates to an improved cooking apparatus having the capability of being configured for use as a grilling device, an oven, and a rotisserie, while possessing means to be self-contained within components comprising the cooking apparatus for convenient storage and transport.

BACKGROUND OF THE INVENTION

Cooking appliances specifically geared for outdoor use have grown substantially over the years due to the progressive development of the technology and the versatility it affords the consumer in cooking foods apart from an indoor environment. Owners and users of outdoor cooking appliances are continually seeking varied functionality that will enhance their outdoor cooking experience at and away from home, in addition to those that are relatively convenient and portable for transport to the campsite or picnic grounds without undue bulkiness. In a conventional sense, the outdoor cooking appliance will generally include components for heat generation, a cooking surface, and an enclosure of some type. Rarely, will the conventional cooking appliance have the capacity to cook foods and the like under a variety of cooking conditions, while having means or the capability of being stored in a compact arrangement.

Although the relevant body of the art discloses numerous devices for cooking outdoors, most are either directed for a specific use without having the capability of being conveniently arranged for storage and transport or lack versatile functionality to cook foods in a varied climatic environment. For instance, U.S. Pat. No. 4,732,138 issued Mar. 22, 1988 to Vos shows a campfire cooking assembly having a grilling surface suspended from a tripod arrangement. Although varied in functionality in that it serves as a cooking apparatus and a smoker, it is bulky and lacks the capability of being conveniently stored for later use or be easily transported to the desired recreational location. Although U.S. Pat. No. 4,120,280 issued Oct. 17, 1978 to Iverson discloses a simplified cooking apparatus having a similar tripod configuration and an adjustable grilling surface suspended therefrom as seen in Vos, it lacks versatility in that it is limited in satisfying varied cooking conditions and capacity to be conveniently stored and portable for transport.

Accordingly, there remains a need for an outdoor cooking apparatus which possess versatility in terms of functioning in adverse and varied climatic conditions, having the capacity of being conveniently packaged for storage or transport to and from the recreational location within components comprising the cooking apparatus, and performing varied cooking operations, such as serving as a grill, rotisserie and oven.

BRIEF SUMMARY OF THE INVENTION

In order to overcome the numerous drawbacks apparent in the prior art, an improved multi-purpose outdoor cooking apparatus has been devised.

It is thus an object of the present invention to provide a low cost non-complicated outdoor cooking apparatus which may be reliably used with a heating source comprised of either charcoal or wood.

It is another object of the present invention to provide such an outdoor cooking apparatus which affords versatility in terms of functioning in varied climatic conditions, such as in the rain and wind.

It is another object of the present invention to provide such an outdoor cooking apparatus which possess the capacity of being self-contained within components comprising the cooking apparatus.

It is another object of the present invention to provide such an outdoor cooking apparatus which can be conveniently transported to and from the recreational location without undue bulkiness.

It is another object of the present invention to provide such an outdoor cooking apparatus which achieves a variety of cooking operations, including, but not limited to, grilling, roasting, and warming.

It is another object of the present invention to provide such an outdoor cooking apparatus which comprises an adjustable cooking surface relative to the heat source to achieve optimized cooking conditions.

It is another object of the present invention to provide such an outdoor cooking apparatus which includes means for uniform cooking of foods and the like above a heat source.

It is yet another object of the present invention to provide such an outdoor cooking apparatus which accomplishes the foregoing and other objects and advantages and which is economical, durable, and fully effective in performing its intended functions.

In accordance with the present invention, a compact multipurpose cooking apparatus adaptable for use in an outdoor environment, the apparatus comprising, in combination, an annular ring having inner and outer diameters, the annular ring comprising at least three apertures positioned within the inner and outer diameters for receiving a corresponding number of the cylindrical fittings; a basin having an inner pitched sidewall and a flange extending outwardly therefrom, the flange comprising at least three apertures for receiving a corresponding number of tapered sleeves to mate and engage with the cylindrical fittings included in the annular rim; a cooking surface having an outer wall attached to the periphery thereof, the cooking surface being suspended within the basin by a plurality of grill clips; a grate having an outer rim in engagement with a plurality of grate clips fixedly attached to the inner pitched sidewall to suspend the grate within the basin; at least three legs comprising upper, middle and lower sections, with the upper section including a threaded portion for threadly engaging the cylindrical fitting of the annular ring for supporting the basin in an elevated position; a dome-shaped cover having a rim extending outwardly therefrom to mate with the flange extending outwardly from the basin, the rim comprising at least three apertures for receiving a corresponding number of tapered sleeves to engage and fit within the tapered sleeves of the basin; a turbine suspended from the dome-shaped cover to promote rotational movement of the cooking surface to uniformly heat foods and the like above a heat source; a common linear support having a first end engaged to an elongate handle fixedly attached to the dome-shaped cover and a second end serving as a common point for connecting at least three linear members which serve to suspend the cooking surface, grate or turbine above the heat source.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is to be considered to exemplify the principles of the present invention and is not intended to limit the invention to the embodiment illustrated. The present invention has particular utility as a device for cooking foods in outdoor environments, particularly under varied and adverse climatic conditions.

Figure 1:
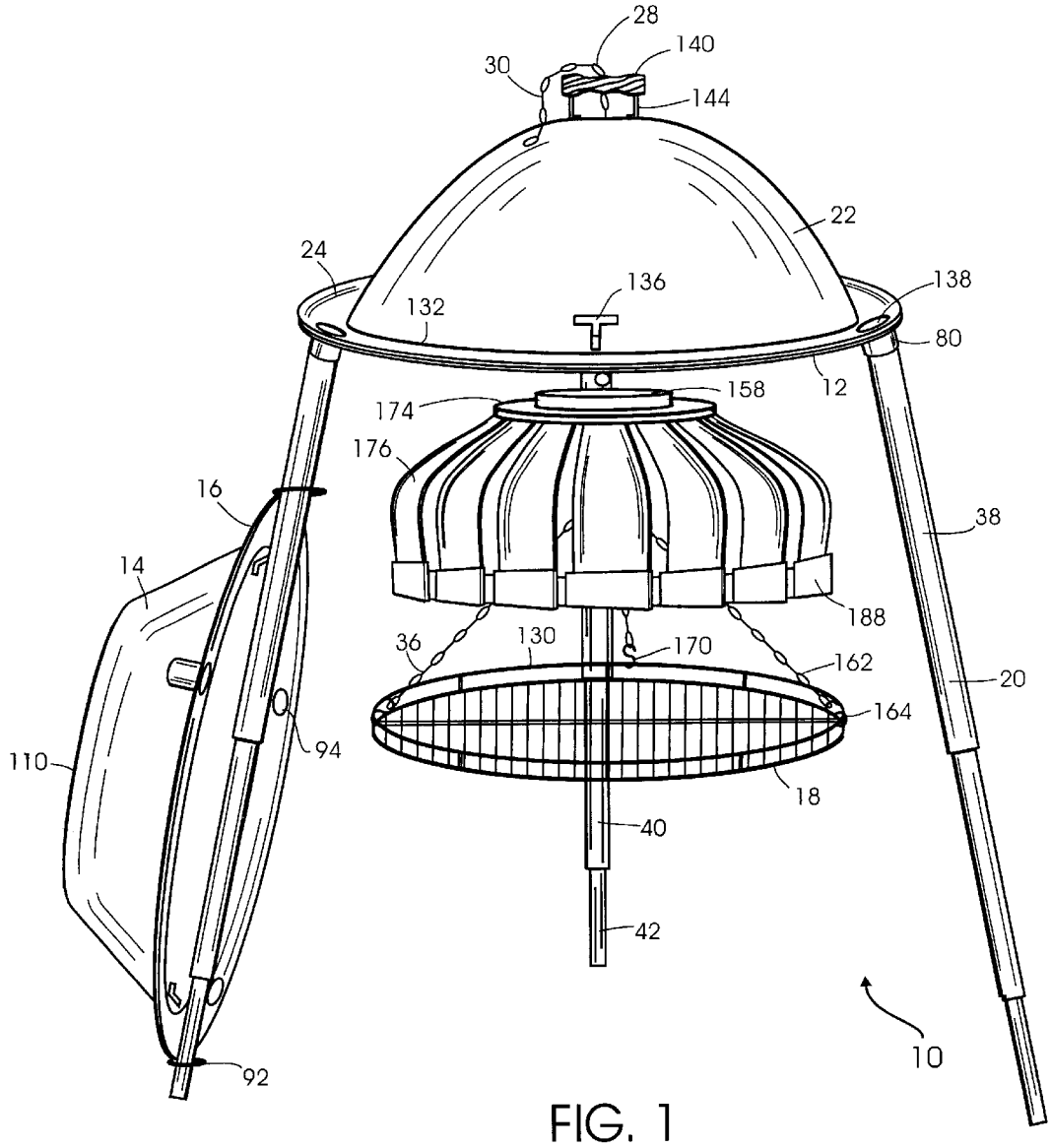
FIG. 1 is a side perspective view of the preferred embodiment of the present invention illustrating the positioning of the basin as a wind block.

Referring to FIG. 1, there is shown generally at 10 a compact multipurpose cooking apparatus for use in outdoor environments, comprising, in combination an annular ring 12, a basin 14 having an upwardly pitched flange 16 extending outwardly therefrom, a cooking surface 18 adaptable to fit within the basin, at least three legs 20 attached to the annular ring for supporting the basin in an elevated position, a dome-shaped cover 22 having a rim 24 extending outwardly therefrom to mate with the flange extending from the basin, a turbine 26 to promote rotational movement of the cooking surface 18 about a heat source, a common linear support 28 having a first end 30 connected to the dome-shaped cover and a second end 32 serving as a common point 34 for connecting at least three linear members 36 which serve to suspend the cooking surface, turbine and/or a grate above the heat source.

Figure 2:
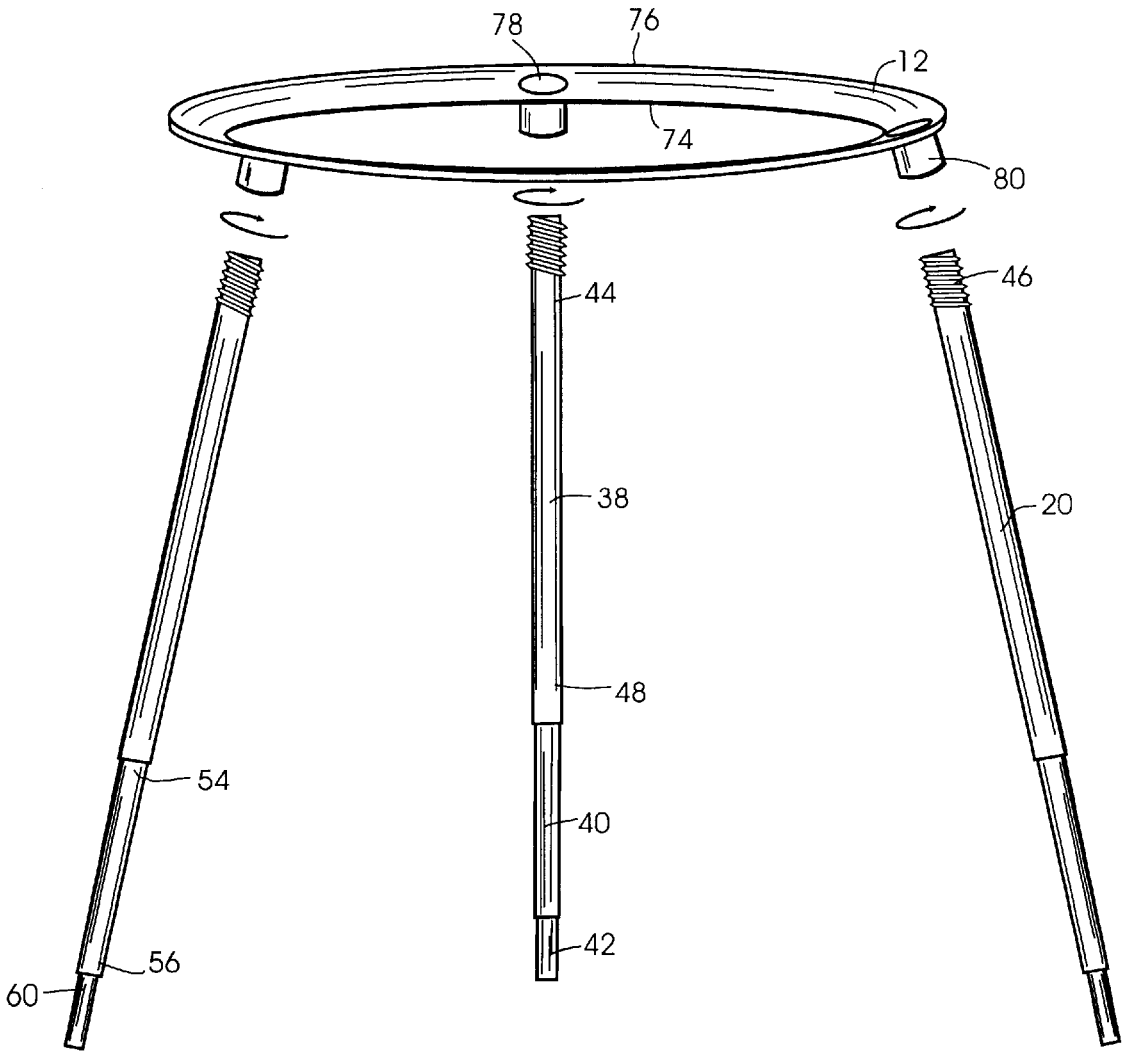
FIG. 2 is a side perspective view of the preferred embodiment of the present invention illustrating the positioning of the legs before assembly to the annular ring.

As depicted in FIG. 2, each of the legs 20 preferably comprises upper 38, middle 40 and lower 42 sections, with each of the sections having a geometric configuration capable of being slidably fitted within one another for compact storage and configured for adjusting the height of the cooking surface relative to the heat source and level positioning of the basin 14 atop of uneven terrain. The upper section generally comprises a top end 44 having an external threaded portion 46 and a bottom end 48 having a plurality of bores 50 extending therethrough for receiving releasable locking means. Each of the upper, middle and lower sections 38, 40, 42 is preferably an elongate cylindrical tube made from materials capable of withstanding moderate to high temperatures that may be encountered during the placement of the basin 14 and legs 20 near the heat source. A material such as aluminum is preferred over other materials such as steel due to its relative weight-to-strength characteristics, ability to withstand moderate temperatures, and non-corrosive properties.

Figure 3:
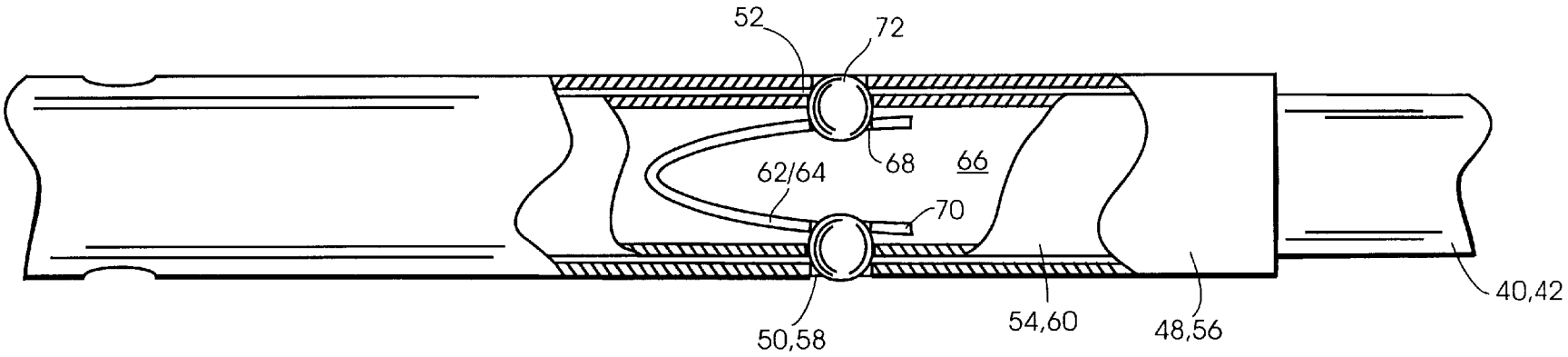
FIG. 3 is a side cross section fragmentary view of the preferred embodiment of the present invention illustrating the locking mechanism housed in the leg sections.

The middle section 40 of each leg is generally geometrically equivalent to the upper section 38 in terms of its elongate cylindrical shape, but having a smaller diameter than the upper section to enable slidable positioning therewithin. The middle section further comprises top 54 and bottom 56 ends, with the bottom end having a plurality of bores 58 extending therethrough for receiving releasable locking means and the top end having releasable locking means fitted therein to engage with the bottom end 48 of the upper section, as shown in FIG. 3. Similarly, the lower section 42 comprises an elongate cylindrical shape, but having a smaller diameter than that of the middle section 40 and even a smaller diameter than that of the upper section 38. The lower section further comprises a top end 60 having releasable locking means fitted therein to engage with the bottom end of the middle section.

In the preferred embodiment, the releasable locking means generally comprises a plurality of spring biased locking clips 62 fitted within the top ends of the middle 40 and lower 42 sections, with the top ends including a pair of diametrically opposed apertures 52. Each locking clip 62 substantially resembles a U-shaped spring 64 of which is specifically fitted within an interior portion 66 of the middle and lower sections, as represented in FIG. 3. The locking clip further comprises an aperture 68 located at each terminal end 70 thereof, with each aperture being geometrically configured to receive a ball 72 having a diameter slightly greater than the diameter of the locking clip's apertures 68, the bores 50, 58 of the bottom ends of the upper and middle sections, and the diametrically opposed apertures 52 present at the top ends 54, 60 of the middle and lower sections. As illustrated in FIG. 3, the locking clip 62 fitted with the balls 72 is generally positioned within the top ends 54, 60 of the middle and lower sections, where the locking clip is allowed to bias the ball 72 against the smaller diameter bores 50, 58 to allow the ball to protrude slightly beyond the smaller diameter diametrically opposed apertures of the top ends 54, 60 of the middle and lower sections.

To facilitate assembly of the upper, middle and lower sections to form a rigid leg, the locking clips 62 present at the top ends of the middle and lower sections are slightly depressed prior to being inserted and slidably positioned within the bottom ends 48, 56 of the upper and middle sections. Once connected in this manner, and ensuring that the locking clips 62 are continually in a depressed position, the locking clip fitted with the balls 72 is rotatably aligned with the selected bore to allow the locking clip to outwardly bias so that each of the balls is slightly protruding beyond the smaller diameter bore, as shown in FIG. 3. Through this positioning, the upper, middle and lower sections are coupled together to form a rigid leg 20 for adequate support of the basin 14 as well as other components comprising the present invention. To disengage the upper, middle and lower sections from one another, or adjust the height of any one of the legs, each section 38, 40 or 42 is counter rotated relative to one another by hand, which depresses the locking clip 62 and dislodges the tip of balls 72 housed in the bores 50, 58 included in the bottom ends of the upper and middle sections. Each section 38, 40 or 42 is then simply slidably released and separated from or fitted within one another for compact storage, or slideably repositioned to the selected bore for height adjustment of the leg. Other similar and readily available means for securing the sections together, such as biasing pins, snaps and the like, are anticipated to fall within the spirit and scope of the present invention. Further, legs 20 made from one piece structure are equally suitable for suspending and elevating the basin, but would lack the capability of being configured for compact, selfs-torage within the basin.

Figure 4:
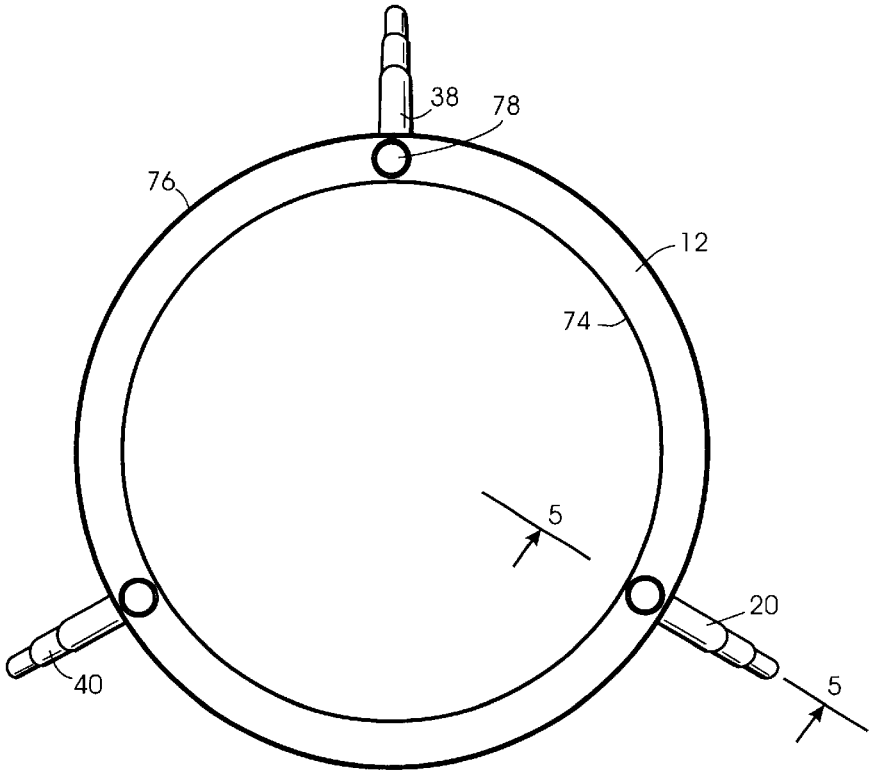
FIG. 4 is a top view of the preferred embodiment of the present invention illustrating the annular ring.
Figure 5:
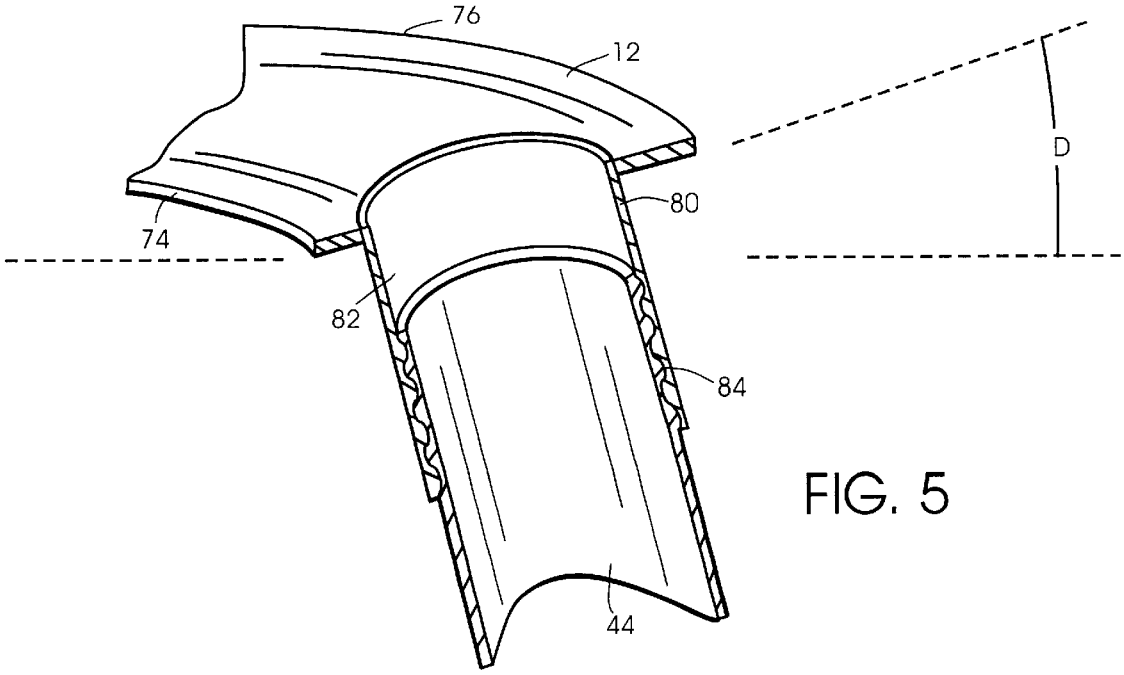
FIG. 5 is a cross section view of the preferred embodiment of the present invention taken on line 5—5 of FIG. 4 illustrating the cylindrical fitting mounted to the annular ring.

Referring now to FIGS. 3–5, the annular ring 12 serve as a common location for attaching the legs 20 and generally comprises inner 74 and outer 76 diameters, with the outer diameter being slightly raised above the inner diameter. In the preferred embodiment, the angular relationship of the outer and inner diameters is approximately 15° from the horizon or from the positioning of the inner diameter, as shown at arc D in FIG. 5 This angular relationship of the inner and outer diameters affords each of the legs 20 to be positioned at an incline, with the upper section 38 being positioned more inward toward the annular ring 12 than that of the lower section 42 of each leg 20. The annular ring further comprises at least three apertures 78 extending therethrough, preferably located equidistant from one another and between the inner 74 and outer 76 diameters of the annular ring, as seen in FIG. 4. The apertures serve as receptacles for a corresponding number of cylindrical fittings 80, which are preferably press fitted therein. Other means known in the art to secure the cylindrical fittings to the annular ring 12, such as being welded or even integrally made part of the annular ring, are worth noting to achieve the desired objectives. Preferably, each of the cylindrical fittings includes an inner wall 82 having a threaded portion 84 thereat for threadably engaging the threaded portion of the top end 44 of the upper section 38, as shown in FIG. 5. After each leg is fully assembled, with the top end of the upper section of each leg being threadably engaged to the cylindrical fitting, the resulting configuration is one which resembles a tripod relationship, with each of the legs being outwardly pitch at the bottom and inwardly pitched at the top for stable positioning of the basin 14, as depicted in FIGS. 1 and 2.

Figure 6:
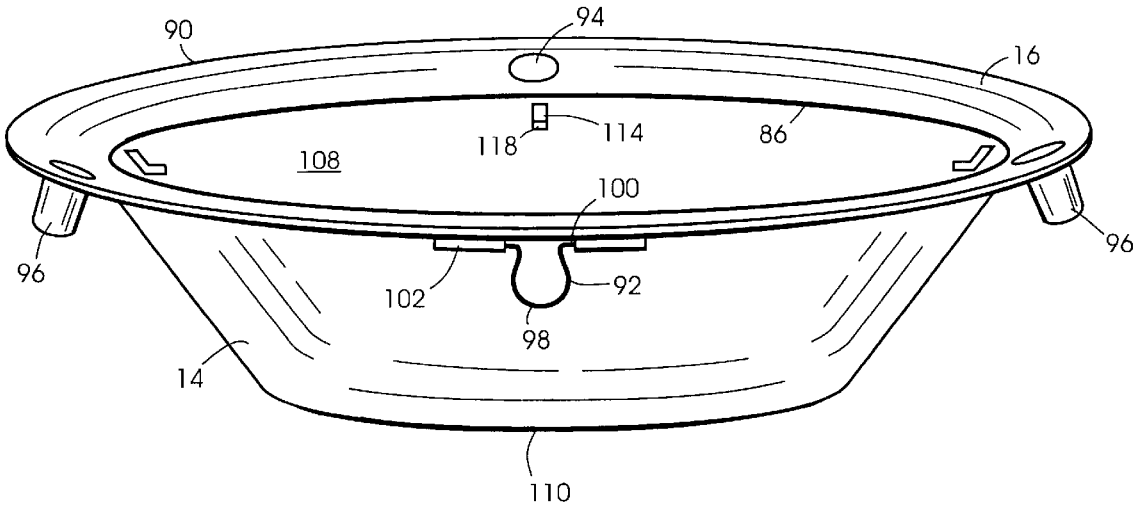
FIG. 6 is a side perspective view of the preferred embodiment of the present invention illustrating the basin.
Figure 7:
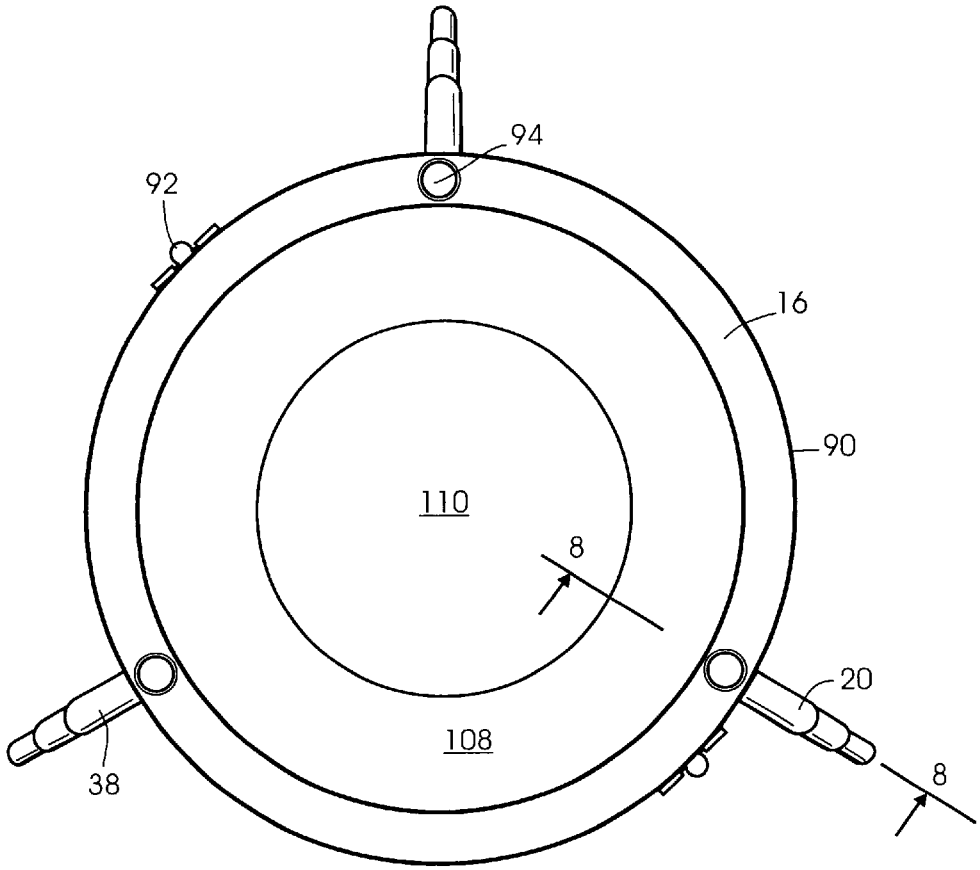
FIG. 7 is a top view of the preferred embodiment of the present invention illustrating the basin.
Figure 8:
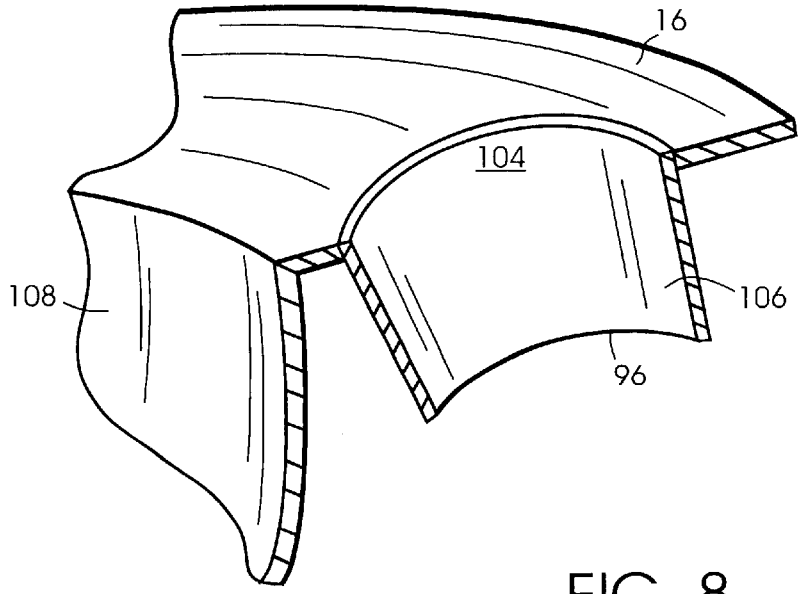
FIG. 8 is a cross section view of the preferred embodiment of the present invention taken on line 8—8 of FIG. 7 illustrating the tapered sleeve mounted to the basin.
Figure 9:
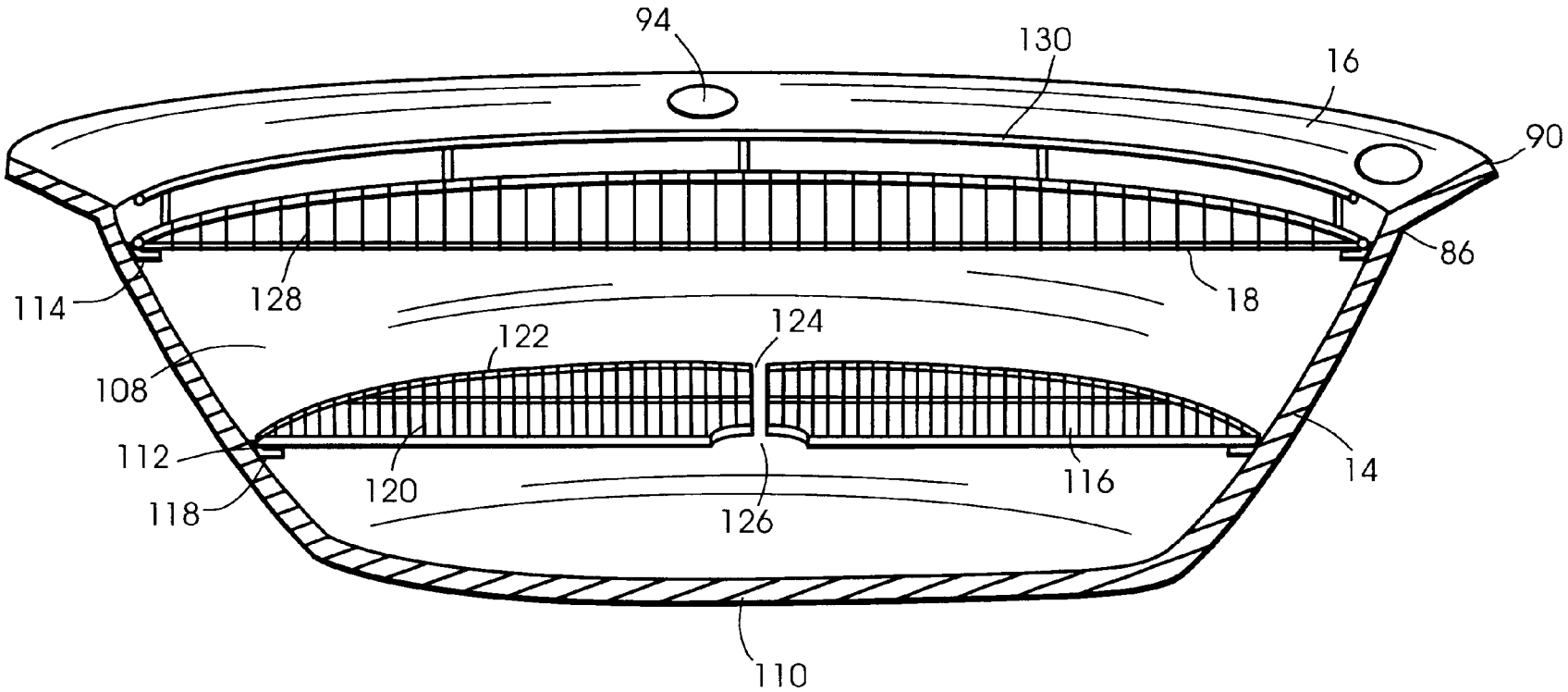
FIG. 9 is a side cross section view of the preferred embodiment of the present invention illustrating the basin fitted with a grate and a cooking surface.

Fitted atop of the annular ring 12 is the basin 14 which serves as a receptacle for charcoal, wood and other materials suitable for ignition to supply heat to the cooking surface, in addition to providing means to effectively block wind and blowing rain when attached to one of the legs, as seen in FIG. 1. As illustrated in FIG. 6, the basin generally comprises an upper periphery 86 with the upwardly pitched flange 16 extending outwardly therefrom. Preferably, the flange comprises an outer leading edge 90 for attaching at least a pair of securing brackets 92 thereto and at least three apertures 94 extending therethrough for receiving a corresponding number of tapered sleeves 96. The flange is preferably pitched upward from the upper periphery 86 of the basin toward the outer leading edge 90, generally corresponding to the angular relationship of the inner 74 and outer 76 diameters of the annular ring 12. Each securing bracket 92, preferably made from heavy gauged wire bent into a loop 98 having terminal ends 100 fitted within a corresponding number of tubular members 102, is located diametrically from one another along the outer leading edge 90 of the flange, as depicted in FIG. 7. The securing brackets serve as means to mount the basin 14 to one of the legs 20 or provide means to temporarily join or secure the basin to the dome-shaped cover 22 for subsequent storage and/or transport of components comprising the present invention. The apertures 94 present in the flange are equally spaced apart from one another, generally corresponding to the positioning of the cylindrical fittings 80 affixed to the annular ring. The tapered sleeves 96 serve as partial means to route rainwater which may accumulate atop and along the flange 16, in addition to serving as means to lock and prevent rotational movement of the basin relative to the annular ring 12. As best seen in FIG. 8, each of the tapered sleeves 96 includes an upper portion 104 which is fixedly attached to the flange and an inner cylindrical wall 106 which is radially pitched inward to permit easy positioning within each of the cylindrical fittings 80 affixed to the annular ring 12. In the preferred embodiment, each of the tapered sleeves 96 is made from the same material as the basin, which is aluminum or an equivalent material, and is pressed fitted within the apertures provided in the flange. The basin 14 further comprises an inner pitched sidewall 108, a bottom 110, and a plurality of inwardly protruding grate clips 112 and grill clips 114 fixedly attached to the inner pitched sidewall. The grate clips serve as means to retain and support a grate 116 for holding wood, charcoal or an equivalent material suitable for ignition, while the grill clips 114 serve as means to support the cooking surface 18 above the grate and heat source. Each grate clip 112, which includes a lower protruding member 118 extending radially inward from the inner pitched sidewall 108, are generally positioned one-third the distance from the bottom of the basin 14, while the grill clips having a similar geometric configuration and a lower protruding member 118 as the grate clips are generally positioned near the upper periphery 86 of the basin where the flange attaches to the basin. As shown in FIG. 9, the grate 116 comprises a plurality of equally spaced bars 120 and an outer rim 122 located along the periphery of the grate, with the outer rim being broken approximately one-half inch by a slot 124 extending radially outward from an aperture 126 centrally located about the grate to the periphery of the grate. The aperture as well as the slot provide passage of the common linear support 28 without complete disassembly of the components comprising the present invention when it is desirable to suspend the grate above and over the heat source. Similarly, the cooking surface 18, which is substantially circular in shape, comprises equally spaced bars 128 fitted within an upwardly extending outer wall 130 fixedly attached along the periphery of the cooking surface. Preferably, the outer wall is approximately one-half inch high and serves as a location to easily grasp the cooking surface for removal from and repositioning about the basin and to attach at least three linear members 36 emanating from the common linear support 28. Additionally, the outer wall 130 may further serve as a barrier to protect food and the like from sliding off the cooking surface as the cooking surface rotates about the common linear support.

Figure 10:
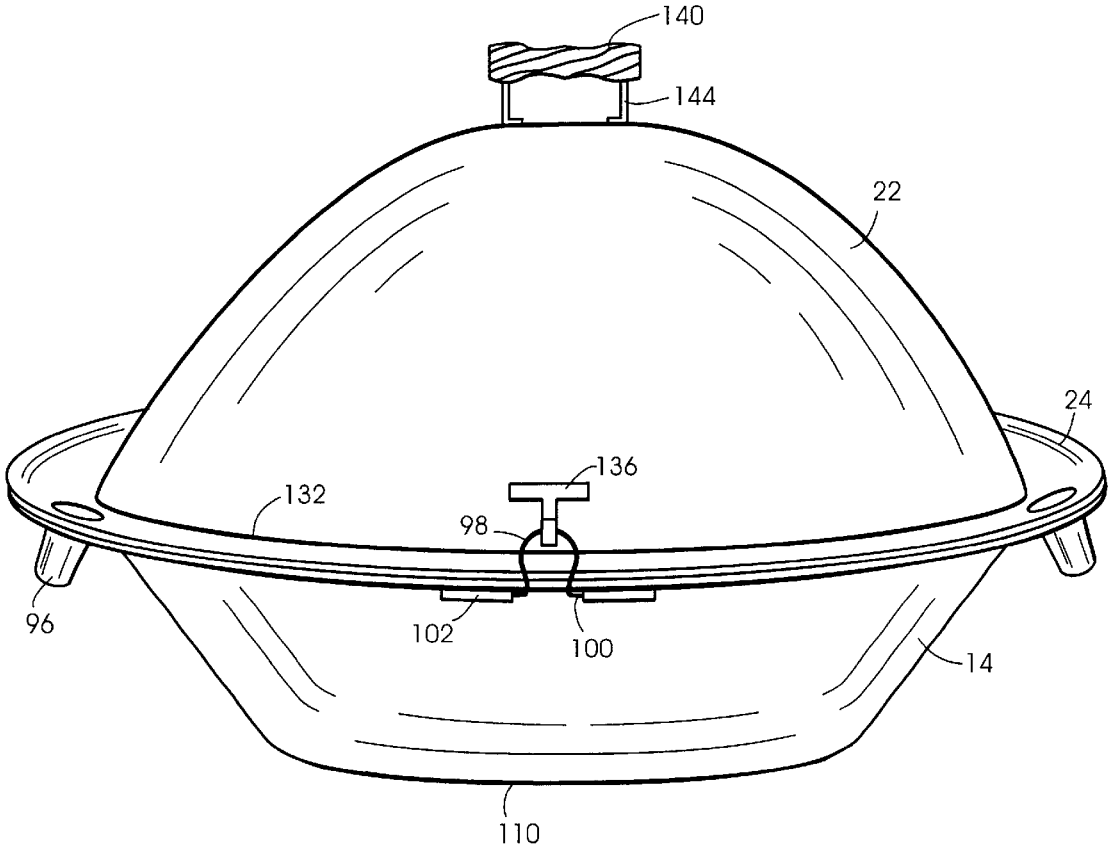
FIG. 10 is a side perspective view of the preferred embodiment of the present invention illustrating the dome-shaped cover fitted to the basin.
Figure 11:
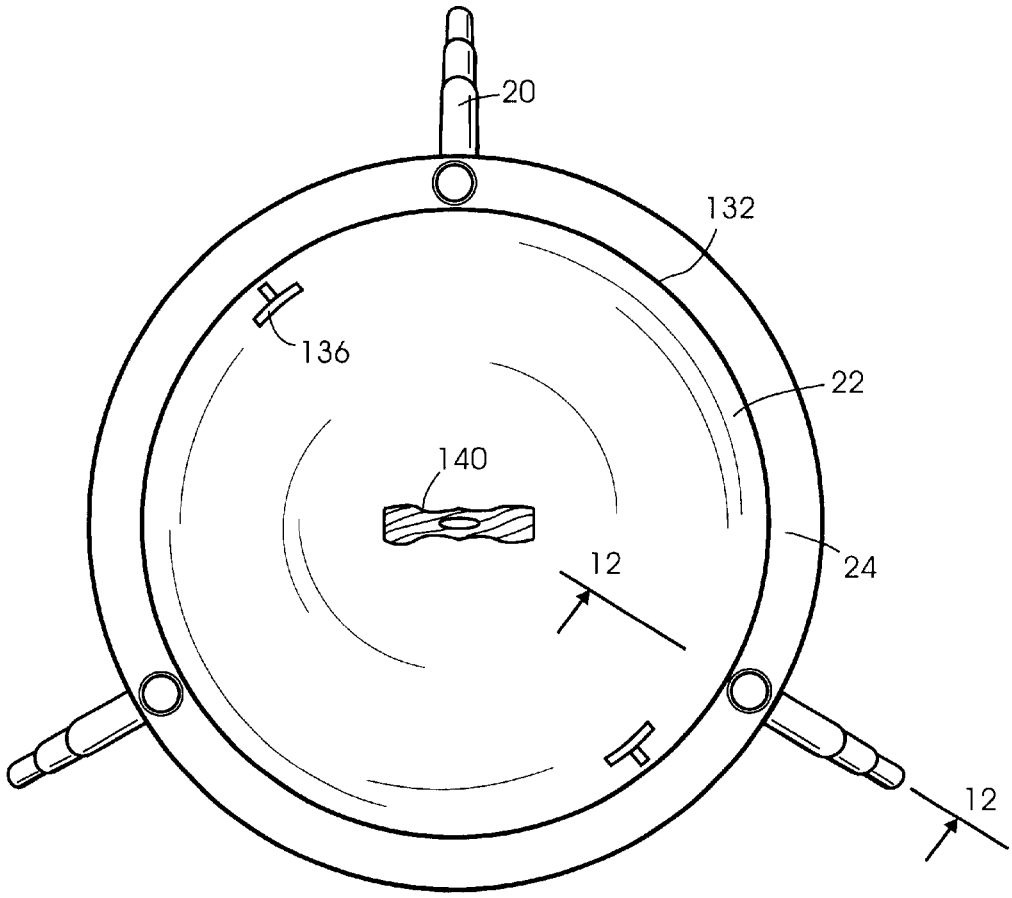
FIG. 11 is a top view of the preferred embodiment of the present invention illustrating the dome-shaped cover.
Figure 12:
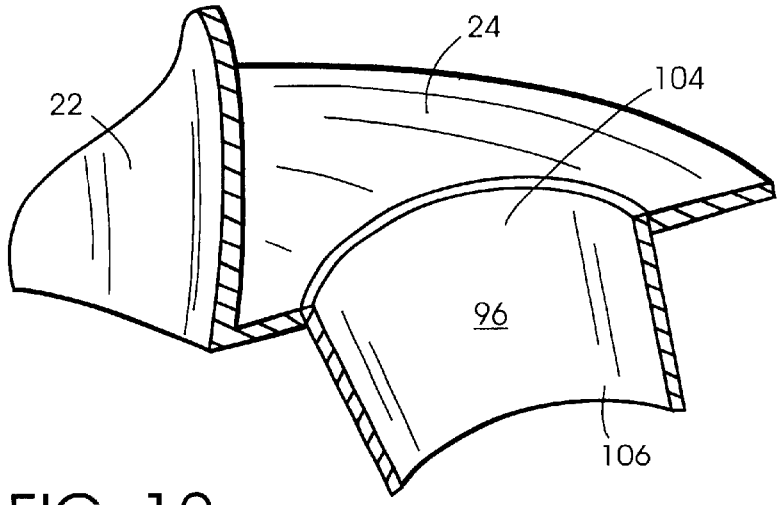
FIG. 12 is a cross section view of the preferred embodiment of the present invention taken on line 12—12 of FIG. 11 illustrating the tapered sleeve mounted to the dome-shaped cover.
Figure 13:
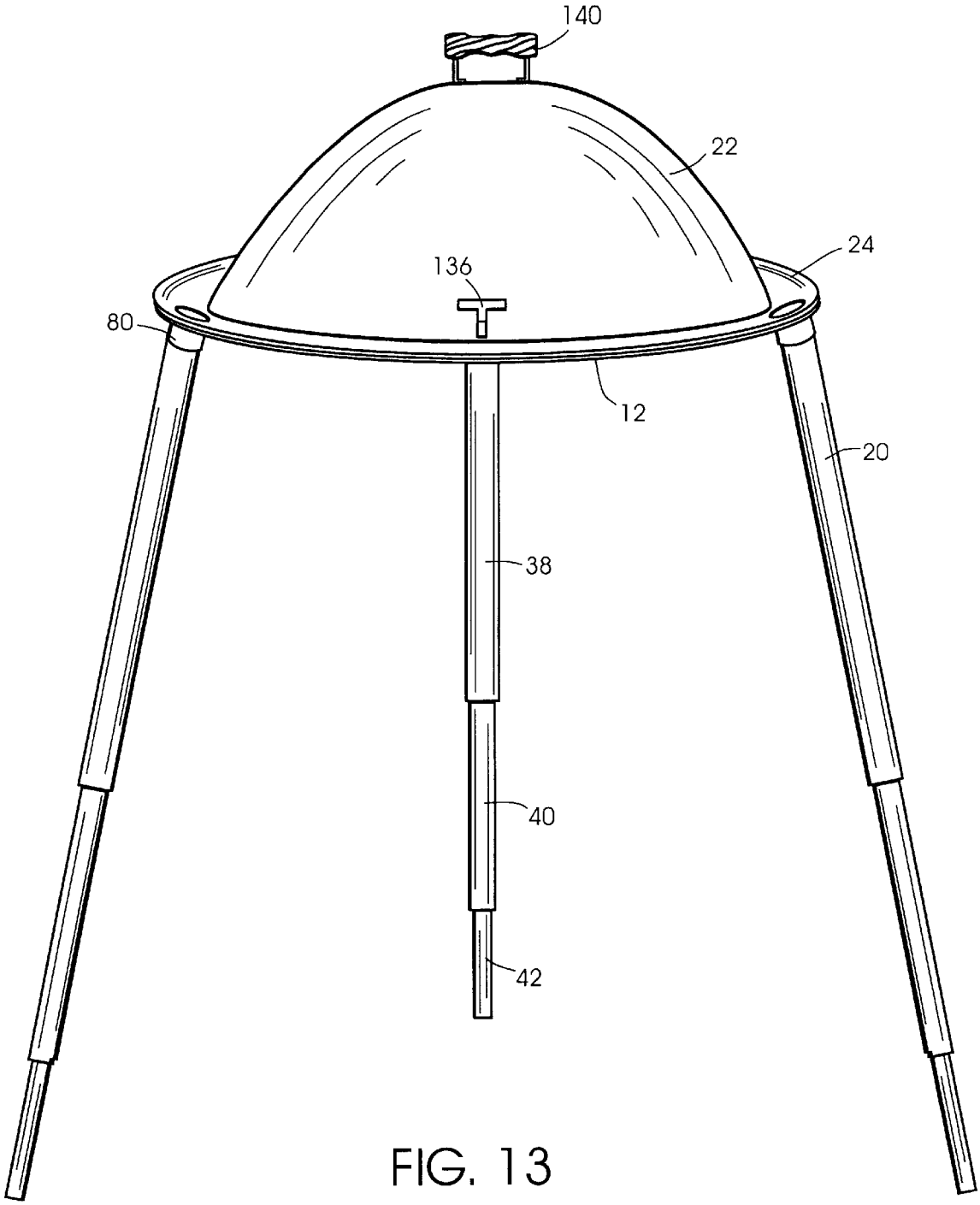
FIG. 13 is a side perspective view of the preferred embodiment of the present invention illustrating the dome-shaped cover fitted to the annular ring and suspended by the legs.
Figure 14:
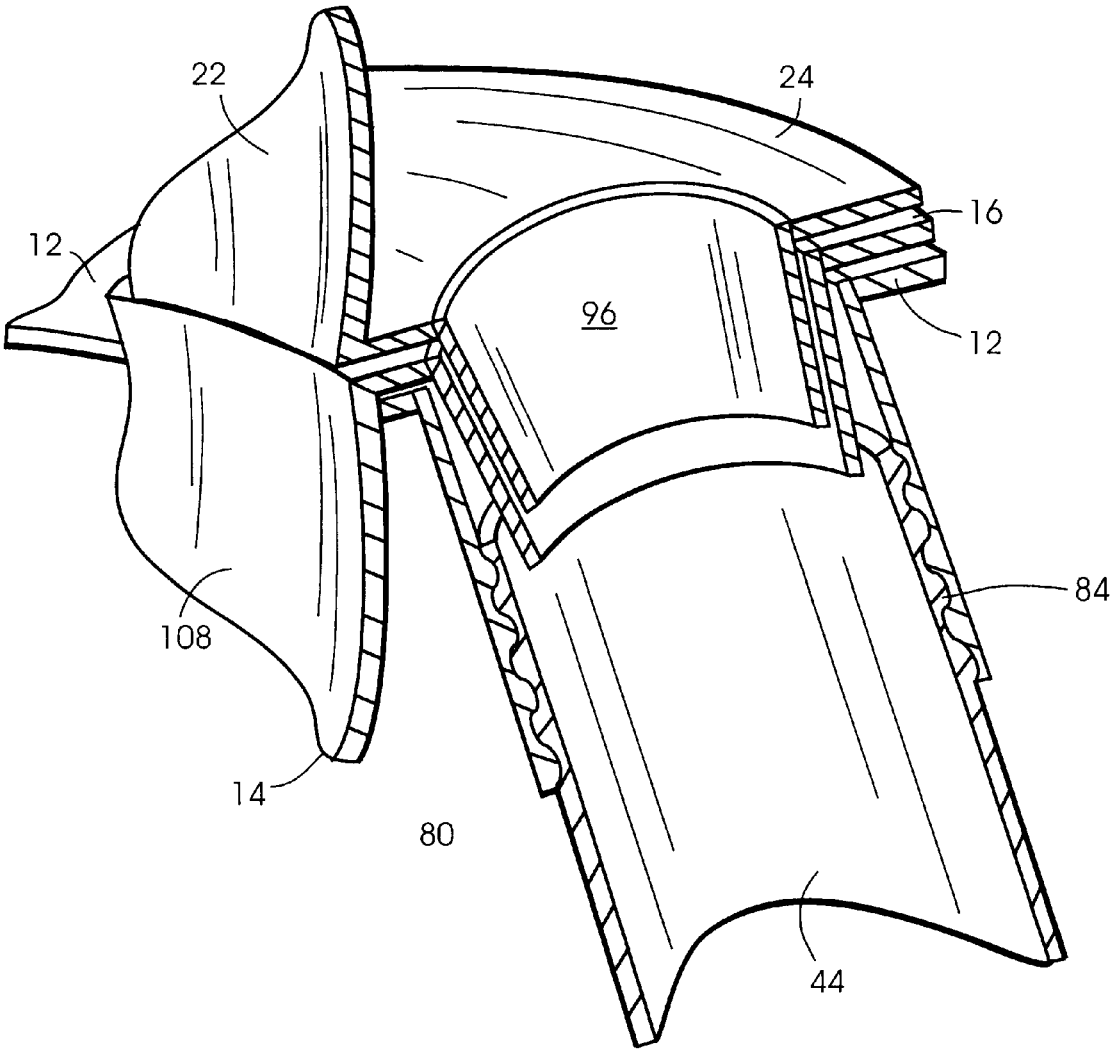
FIG. 14 is a cross section view of the preferred embodiment of the present invention illustrating the tapered sleeves of the dome-shaped cover and basin fitted within the cylindrical fitting of the annular ring.

As shown in FIGS. 10–12, the dome-shaped cover 22 includes a bottom leading edge 132 where the rim 24 extends outwardly therefrom, a centrally located aperture 134 for passage of the common linear support 28, and at least a pair of receiving hooks 136 diametrically mounted from one another to the dome-shaped cover, near the bottom leading edge 132. The dome-shaped cover serves as a versatile component of the present invention in that it is geometrically configured to protect the cooking surface 18 or alternatively to shield the fire pit or heat source when supported by the annular ring 12 and legs 20, as illustrated in FIG. 13. In the preferred embodiment, the rim 24 comprises at least three apertures 138 equally spaced apart from one another, generally corresponding to the positioning of those included in the flange of the basin and annular ring, as best in seen in FIG. 11. Similar to the geometric configuration of the flange and annular ring, the rim is generally pitched upward and outward from the bottom leading edge 132 of the dome-shaped cover. This configuration provides for protected accessibility to the fire pit or heat source as falling rainwater hits the dome-shaped cover and collects at and along the rim. Water accumulated at the rim 24 is then displaced and removed through the presence of the tapered sleeves 96 that are circumferentially positioned about and fitted within the apertures included in the flange of the basin and rim of the dome-shaped cover and the cylindrical fittings 80 fitted to the annular ring, as depicted in FIG. 14. Water passing through the tapered sleeves and cylindrical fitting is then permitted to be channeled to the ground surface via the legs 20 threadly attached to the cylindrical fittings for subsequent absorption by the surrounding soils. In the event of adverse weather or environmental conditions, specifically during blowing conditions, the heat source can be further protected by positioning and temporarily joining the basin 14 to one of the legs, as described hereinbefore. By positioning the dome-shaped cover to the annular ring 12 and the basin to one of the legs 20, the heat source is adequately protected for outdoor cooking, as illustrated in FIG. 1.

Figure 15:
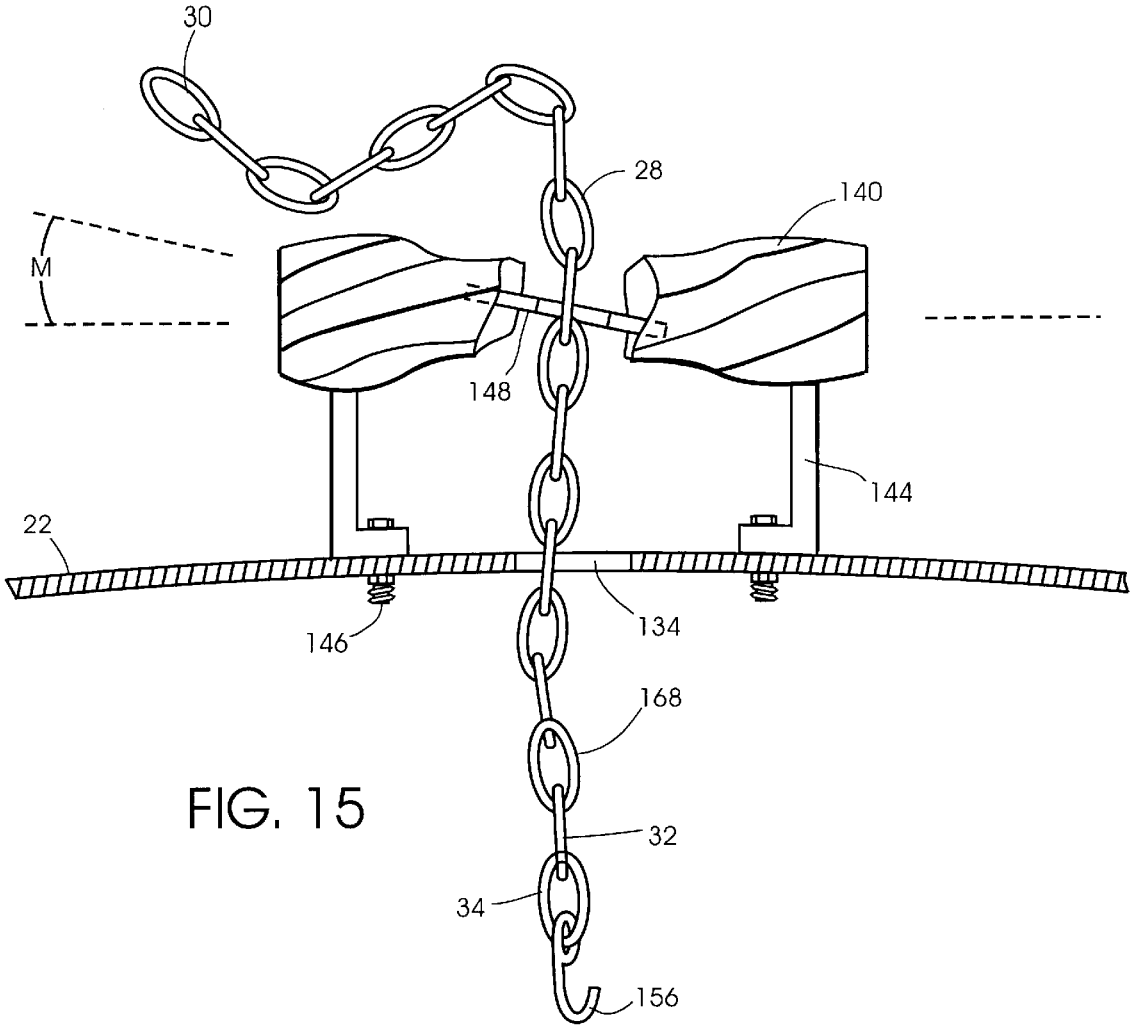
FIG. 15 is a side elevation and cutaway view of the preferred embodiment of the present invention illustrating the handle assembly.
Figure 16:
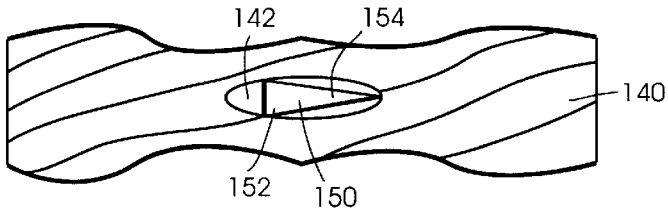
FIG. 16 is a top view of the preferred embodiment of the present invention illustrating the handle assembly of FIG. 15.

Referring now more particularly to FIGS. 15 and 16, the dome-shaped cover 22 further comprises an elongate handle 140 having an oval-shaped bore 142 extending therethrough for passage of the common linear support 28 and a pair of mounting brackets 144 fixedly attached to the dome-shaped cover 22 by screws 146 or equivalent fastening means, as shown in FIG. 15. Preferably, the oval-shaped bore extends perpendicular to the longitudinal axis of the handle, as seen in FIG. 16. Fitted within the handle 140 and partial exposed by the bore is a plate 148, which serves as partial means to lock and secure the common linear support 28 in a stationary, stable position. The plate, preferably made from steel or equivalent material, generally includes a triangular-shaped aperture 150 and is positioned lengthwise within and about the handle 140 and inclined by approximately 30° from the longitudinal axis of the handle, as depicted along arc M in FIG. 15. Locking of the common linear support 28 is achieved by simply pulling the common linear support upward through a larger portion 152 of the triangular-shaped aperture, where the common linear support is free to travel vertically, and swinging the first end 30 of the common linear support along the longitudinal axis of the handle, toward a narrow portion 154 of the triangular-shaped aperture, where it is allowed to engage and pinch a portion of the common linear support for prolonged positioning thereof.

Figure 17:
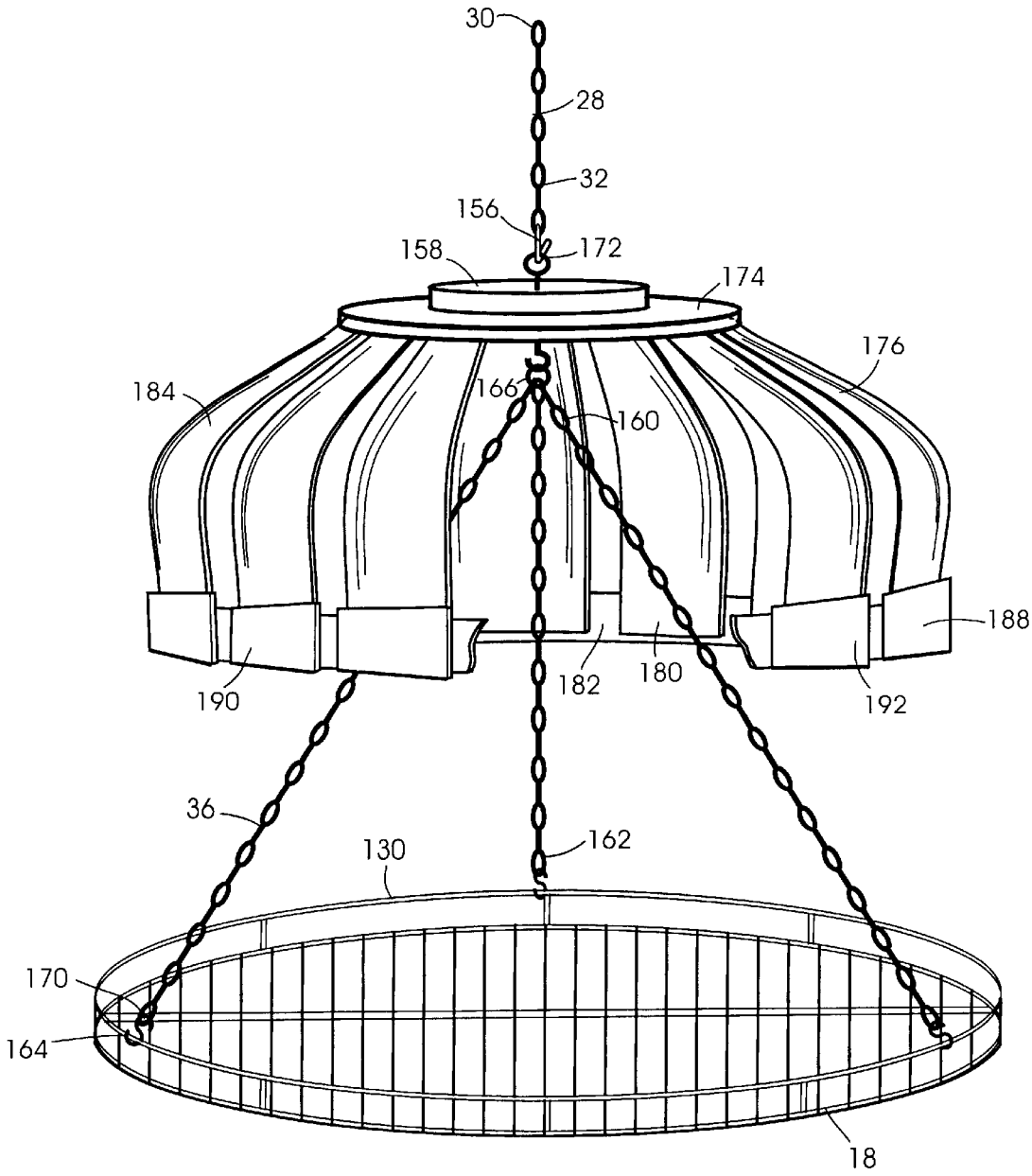
FIG. 17 is a side cutaway view of the preferred embodiment of the present invention illustrating the positioning of the turbine relative to the cooking surface.
Figure 18:
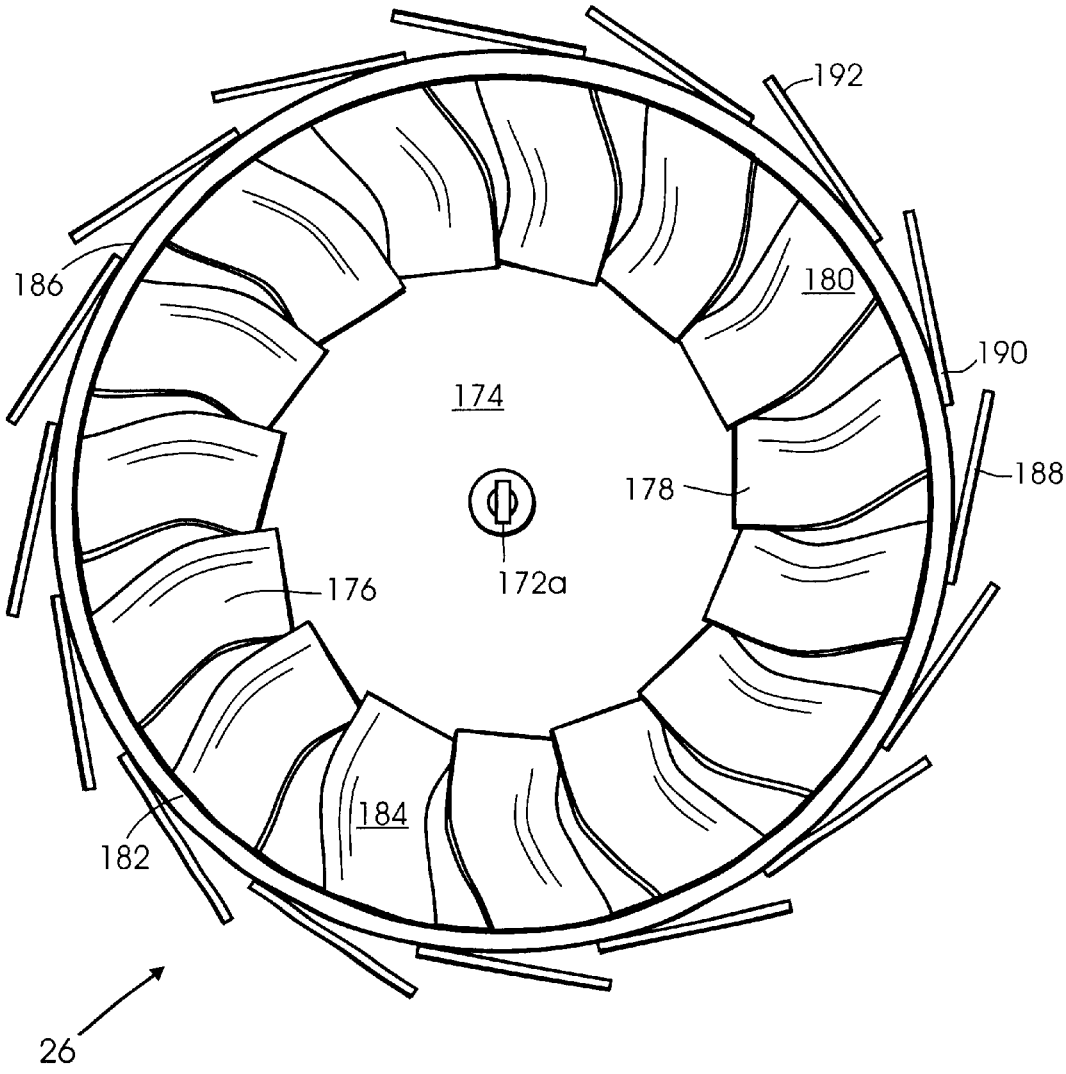
FIG. 18 is a bottom view of the preferred embodiment of the present invention illustrating the components comprising the turbine.

The first end 30 of the common linear support is configured to passes through the centrally located aperture of the dome-shaped cover 22 and triangular-shaped aperture 150 of the plate and oval-shaped bore 142 of the handle 140, while the second end 32 includes a common hook 156 attached thereto for attaching at least three linear members or to a mounting disk 158, as shown in FIG. 17. The linear members 36, each having a top end 160 and a bottom end 162, generally serve as means for suspending and supporting the cooking surface 18 when directly used over the heat source or the grate when used as a warming rack. The bottom ends of each of the linear members are generally configured to be either temporarily joined to the outer wall 130 of the cooking surface or to the outer rim 122 of the grate 116 through use of a corresponding number of S-hooks 164 fitted thereto, while the top ends of the linear supports are fitted to a common suspending ring 166. The suspending ring serves as a common point 34 to either engage the common hook 156 fixedly attached to the second end of the common linear support 28 for direct support of the cooking surface above the heat source or to the mounting disk 158 made part of the turbine 26, as best seen in FIG. 17. In the preferred embodiment, the linear members 36 and common linear support comprise of chains having a plurality of links 168 fitted to one another in series which are adaptably configured to receive an end 170 of each of the S-hooks. The linear members, as well as the common linear support 28, may comprise of cable, wire or other materials known in the art having the capacity to suspend and support the components hereinbefore described. As illustrated in FIG. 17, the mounting disk 158 generally comprises a receiving or swivel loop 172 connected thereto and centrally located thereabout to receive the common hook 156 made part of and fitted to the second end 32 of the common linear support. The receiving or swivel loop further comprises a hook 172*a* located opposite to it where connects to the second end of the common linear support and is preferably configured to allow free rotation of the turbine without allowing the common linear support to twist thereabout as the turbine 26 and associated components rotate in unison with the cooking surface 18 above the heat source. The turbine, comprising in part the mounting disk, further comprises a circular plate 174 and a plurality of arcuate-shaped fins 176 having a top end 178 fixedly attached to the circular plate and an opposing end 180 fixedly attached to a bottom ring 182 having a diameter larger than that of the circular plate 174, as shown in FIG. 18. Preferably, the diameter of the bottom ring is approximately one-third larger than the diameter of the circular plate to allow the arcuate-shaped fins to be positioned at an incline toward the smaller diameter circular plate. As shown in FIGS. 17 and 18, each fin 176 further comprises a middle section 184 which serves as a location where the top end of each fin is substantially bent inward toward the smaller diameter circular plate. In the preferred embodiment, the area between the opposing end 180 and middle section substantially forms a vertical plane, while the area between the top end and middle section substantially forms a plane that is pitched inward toward the cylindrical plate 174 by approximately 45° relative to the vertical plane defined by the opposing end and middle section, as best depicted in FIG. 17. To enhance rotational movement of the turbine 26 about the heat source, each fin 176 is spaced apart from one another by approximately one-third the width of each fin, while the top end 178 of each fin is fixedly attached to the circular plate in an angular fashion of approximately 30 degrees, forming an air foil design for rotational propulsion of the turbine about the common linear support 28. The resulting configuration promotes ample venting of hot air through the fin-defined spaces, while allowing hot air to travel and flow over the surface of each fin 176 for turning the turbine 26 in unison with the cooking surface 18 through use of the combined swivel loop 172 and hook 172*a* attached to the mounting disk 158.

Referring now to FIG. 18, the bottom ring 182 further comprises an exterior surface 186 for mounting a plurality of horizontal fins 188, each having a tail end 190 fixedly attached to the exterior surface of the bottom ring and a free end 192 extending outwardly therefrom. Although configured somewhat similar to the arcuate-shaped fins 176 in that each horizontal fin is positioned circumferentially about the bottom ring 182, each horizontal fin is specifically positioned lengthwise in series, with the free end 192 being positioned where the tail end is joined to the bottom ring and thereabove by approximately one-half inch, as depicted in FIG. 18. The resulting arrangement of the horizontal fins 188 circumferentially positioned about the exterior surface 186 of the bottom ring aids in the rotational motion of the turbine in the event that the thermal updraft created by the heat source is disturbed and interrupted by blowing cross winds, which may cause the turbine 26 and connected cooking surface 18 to sit idle over the heat source. Only through arrangement of the arcuate-shaped 176 and horizontal fins 188 about the bottom ring 182 will the turbine 26 rotate the cooking surface 18 to uniformly cook foods and the like about and above the heat source, notwithstanding the presence of adverse environmental conditions.

Figure 19:
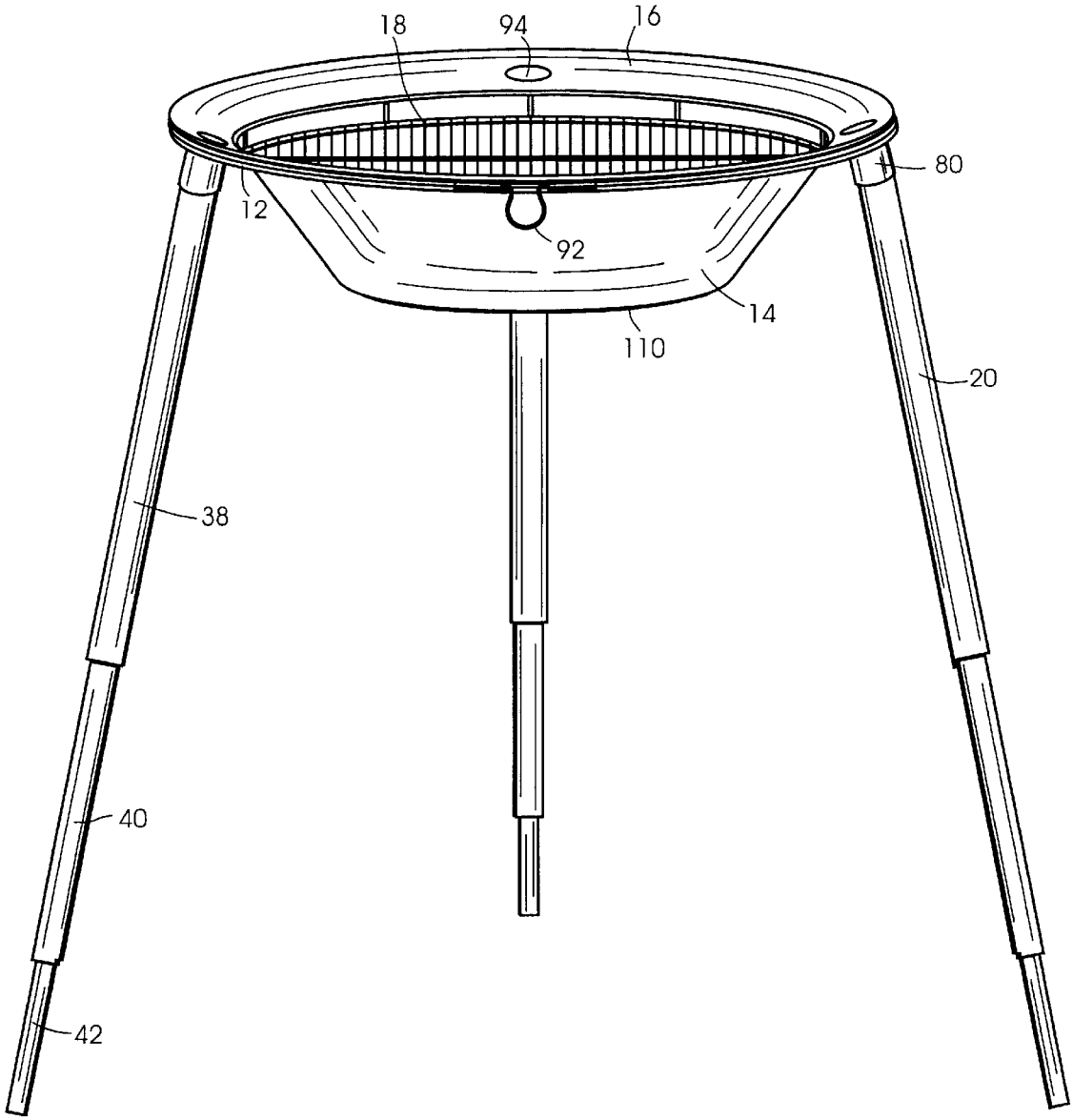
FIG. 19 is a side perspective view of the preferred embodiment of the present invention illustrating the basin fitted with the cooking surface and suspended by the legs.
Figure 20:
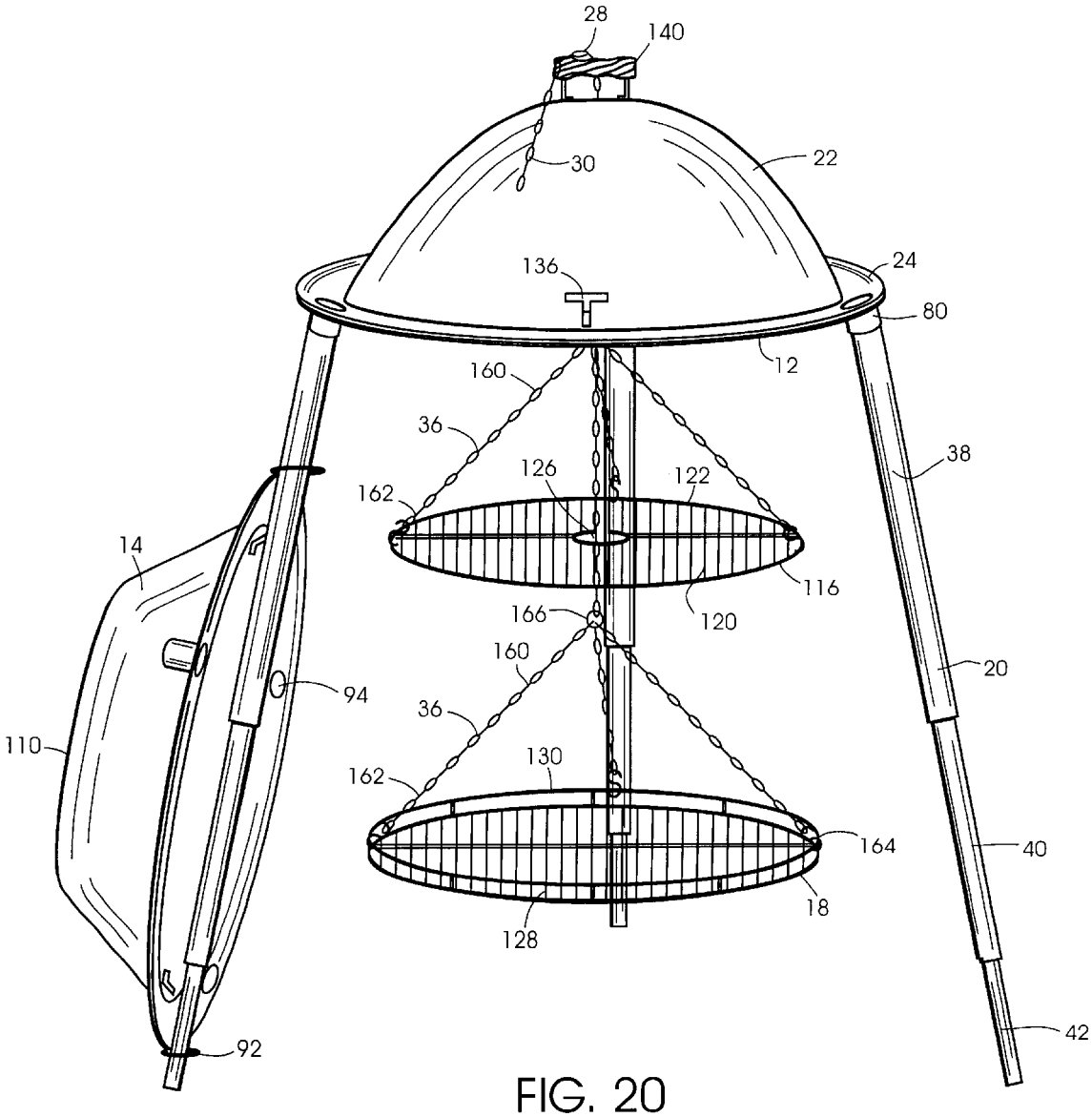
FIG. 20 is a side perspective view of the preferred embodiment of the present invention illustrating the positioning of the basin as a wind block and the suspending of the cooking surface and grate.
Figure 21:
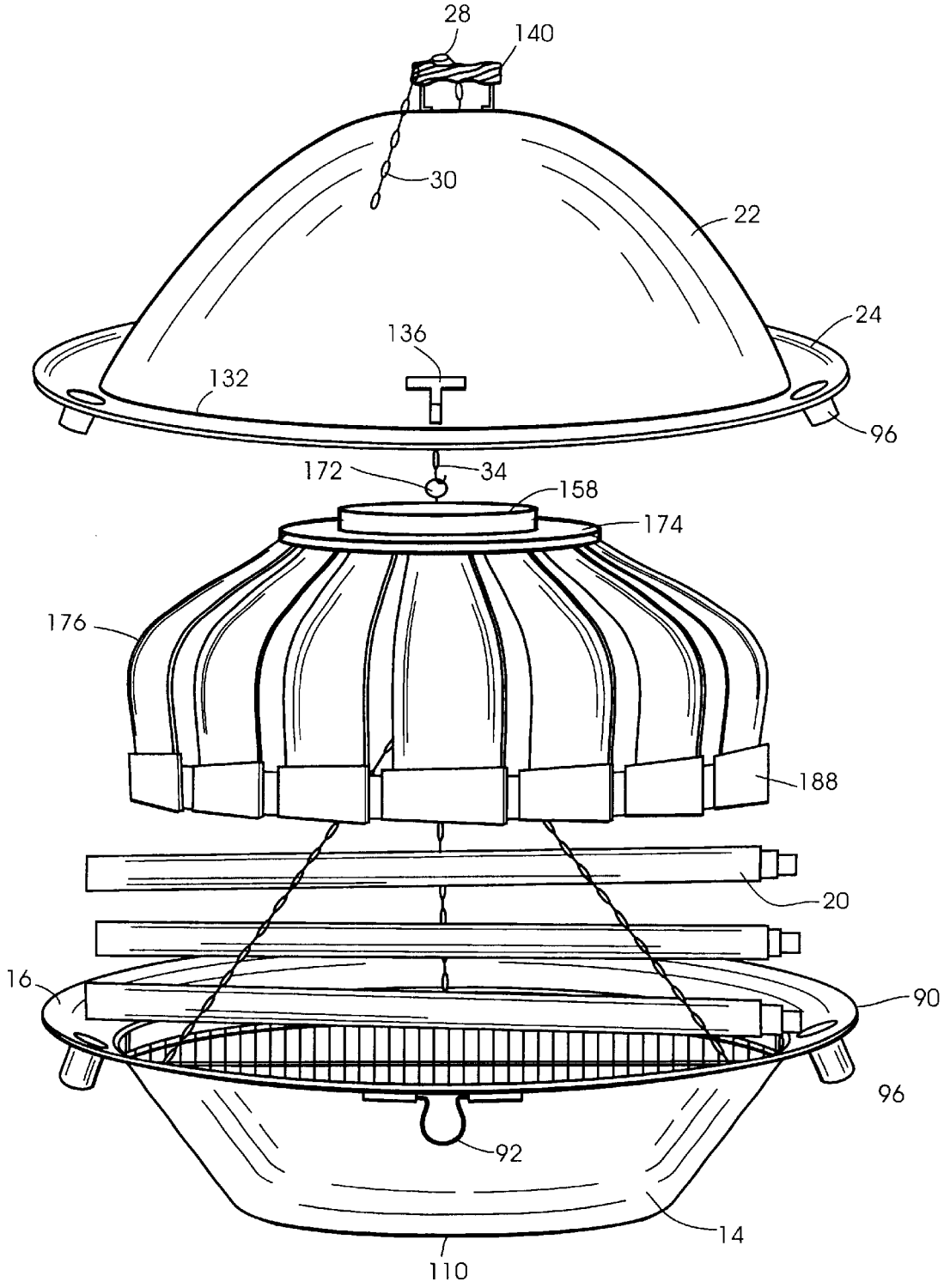
FIG. 21 is a side perspective view of the preferred embodiment of the present invention illustrating the arrangement of the turbine, legs, and cooking surface relative to the basin and dome-shaped cover prior to being stored therein.

As depicted in FIGS. 13, 19–21, the present invention can be configured in numerous ways. One such configuration includes the assembly of the annular ring 12 with the legs 20 and fitting thereon the basin fitted with the grate and cooking surface to form a typical grilling arrangement, as shown in FIG. 19. In yet another simple configuration, the dome-shaped cover 22 is fitted onto the annular ring 12 to shield a fire pit or the heat source during inclement weather conditions, as seen in FIG. 13. The legs 20 can then be substantially adjusted upward or downward to accommodate the height of the heat source. In another configuration, with the dome-shaped cover still mounted to the annular ring 12, the cooking surface 18 is directly suspended over the heat source, while the grate 116 is suspended over the heat source to serve as a warming rack. This arrangement, as shown in FIG. 20, is accomplished by simply using the common linear support emanating from the dome-shaped cover 22 and attaching the second end thereof to the suspending ring 166 fitted to the top ends of the linear members, with the bottom ends 162 of the linear members 36 being attached to the outer wall 130 of the cooking surface using S-hooks 164 and the common linear support passing through the aperture 126 provided in the grate. Somewhat similar to the manner described for suspending the cooking surface, the grate is suspended from the dome-shaped cover by connecting the suspending ring 166 fitted to the top ends 160 of the linear members to the common linear support 28 using one of the S-hooks 164, with the bottom ends 162 of the linear members being attached to the outer rim of the grate using similar S-hooks, as shown in FIG. 20. Adjustment of the cooking surface and grate is simply achieved by disengaging the first end 30 of the common linear support from the plate 148 included in the elongate handle 140 and pulling either upward or downward through the triangular-shaped aperture 150 the common linear support 28 to the desired height or length. The common linear support 28 is then re-engaged to the handle by pulling the first end of the common linear support along the longitudinal axis of the elongate handle until it is adequately and securely fitted within and locked into the narrow portion 154 of the triangular-shaped aperture 150 included in the plate 148. With any of the configurations described above, the basin 14 may serve as added means to effectively protect the heat source from blowing wind and rain when the same is mounted to one of legs 20 using the securing brackets 92 attached to the leading edge 90 of the basin 14. In yet another configuration, the turbine 26 can be suspended in conjunction with the cooking surface to provide enhanced cooking conditions through unison rotational motion of the turbine and cooking surface over the heat source. In this configuration, which allows for uniform application of heat to the cooking surface, the common hook 156 fitted to the second end 32 of the common linear support 28 is directly joined to the receiving or swivel loop 172 connected to the mounting disk 158, while the first end 30 of the common linear support is retained in the plate 148 included in the handle 140. The top ends 160 of the linear members are then attached to the turbine 26 by simply engaging the suspending ring 166 with that of the hook 172*a* of the receiving or swivel loop 172 attached to the mounting disk 158, while the bottom ends 162 of the linear members 36 are attached to the outer wall 130 of the cooking surface 18 using S-hooks 164, as illustrated in FIG. 17. Should it be desirable to pack the present invention for either short- or long-term storage or transport, the basin 14 as well as the dome-shaped cover 22 may serve as a receptacle for other components comprising the present invention. Packing of the present invention is accomplished by disassembling the dome-shaped cover from the basin and basin from the annular ring 12 and unscrewing the legs from the cylindrical fitting 80 included in the annular rim. The legs 20 are then further disassembled by counter rotating the middle 40 and lower 42 sections of the legs, which causes the balls 72 fitted within the apertures included in the middle and lower sections to be depressed and pulling apart from another the leg sections 38, 40, 42. Alternatively, since each leg section comprises a geometric configuration of smaller, descending diameters, each leg section can be slideably positioned within one another for compact storage. As shown in FIG. 21, the legs, turbine, grate, cooking surface, and linear members are collectively gathered and placed into and within the basin, with the dome-shaped cover being fitted thereover and secured in place by engaging the securing brackets 92 attached to the leading edge 90 of the basin with the receiving hook 136 fixedly attached to the dome-shaped cover 22.

It can be seen from the foregoing that there is provided in accordance with this invention a simple and easily operated device, which is particularly suitable for use in outdoor environments. The multipurpose cooking apparatus is completely functional in adverse as well as in varied climatic conditions which may come about as one cooks foods in an outdoor environment and away from home.

It is obvious that the basin, dome-shaped cover 22 and legs 20 may be fabricated from a variety of materials, providing such selection or use of materials possess the capacity of withstanding moderate to high temperatures as each is placed near the heat source. It is most desirable, and therefore preferred, to construct the foregoing components from aluminum.

While there has been shown and described a particular embodiment of the invention, it will be obvious to those skilled in the art that various changes and alterations can be made therein without departing from the invention and, therefore, it is aimed in the appended claims to cover all such changes and alterations as fall within the true spirit and scope of the invention.

What is claimed is:

1. A compact multipurpose cooking apparatus for use in outdoor environments, comprising, in combination:

an annular ring having at least three apertures extending therethrough, equidistant from one another;

a basin having a flange extending outwardly therefrom, said flange having a geometric configuration corresponding to said annular ring and comprising at least three apertures extending therethrough and being positioned to align with the apertures of said annular rim;

suspending means for supporting said basin and said annular ring in an elevated position, said suspending means being fixedly connected to said annular ring at locations of the aligned apertures of said flange and said annular ring;

a dome-shaped cover having a rim extending outwardly therefrom, said rim having a geometric configuration corresponding to said flange of said basin and said annular rim and comprising at least three apertures extending therethrough and in alignment with the apertures of said flange and said annular ring, whereby the aligned apertures of said annular ring, said flange, and said rim, collectively in alignment with said suspending means, effectively serve to channelize and drain accumulated water from said dome-shaped cover for protected accessibility to a heat source during inclement climatic conditions.

2. A compact multipurpose cooking apparatus as set forth in claim 1, wherein said suspending means comprises at least three legs, each having an upper, middle and lower sections geometrically capable of being slidably fitted within one another for adjustment above the heat source and locked in placed by releasable locking means, said suspending means further comprising attachment means for securing said upper section to said annular ring.

3. A compact multipurpose cooking apparatus as set forth in claim 2, wherein said attachment means comprises a corresponding number of cylindrical fittings engagingly fitted within each of said apertures of said annular ring and having a threaded inner wall to threadably engage an external threaded portion of said upper section.

4. A compact multipurpose cooking apparatus as set forth in claim 1, wherein said annular rim, said flange of said basin and said rim of said dome-shaped cover are upwardly pitched to allow inclined positioning of said suspending means.

5. A compact multipurpose cooking apparatus as set forth in claim 2, wherein said releasable locking means comprises a plurality of spring biasing locking clips each substantially resembling a U-shape having terminal ends with apertures extending therethrough for receiving a ball of greater diameter than the diameter of said aperture, each of said middle and lower sections further comprising top ends each having a pair of diametrically opposed apertures extending therethrough for receiving a portion of said ball fitted within each of said apertures located at terminal ends of said locking clip, said upper and middle sections further comprising bottom ends having a plurality of bores extending therethrough for receiving a portion of said ball to lock said top ends of middle and lower sections with said bottom ends of said upper and middle sections, respectively, each of said locking clips being positioned and housed in each of said top ends of middle and lower sections.

6. A compact multipurpose cooking apparatus as set forth in claim 1, wherein said basin further comprises an inner pitched sidewall for mounting a plurality of grill clips protruding inwardly to suspend a cooking surface above a grate and heat source and a plurality of grate clips for suspending the grate above the heat source, each of said grill and grate clips being placed equidistant from one another within said basin about said inner pitched sidewall.

7. A compact multipurpose cooking apparatus as set forth in claim 6, wherein said grate further comprises an outer rim substantially broken in part by a slot emanating from an aperture substantially located in the center of said grate and extending radially outward from said aperture of said grate to said outer rim.

8. A compact multipurpose cooking apparatus as set forth in claim 6, wherein said cooking surface further comprises an upwardly extending outer wall along the periphery thereof to serve as a location for attaching at least three linear members using a corresponding number of S-hooks fitted thereto for suspension of said cooking surface above a heat source.

9. A compact multipurpose cooking apparatus as set forth in claim 1, further comprising rotating means for turning a cooking surface about and above a heat source to uniformly heat foods and the like residing thereon, said rotating means being substantially positioned above and near said cooking surface and below said dome-shaped cover.

10. A compact multipurpose cooking apparatus as set forth in claim 9, wherein said rotating means comprises a plurality of arcuate-shaped fins having a top end fixedly attached to a circular plate in an angular fashion, an opposing end fixedly attached to a bottom ring having a diameter larger than the diameter of said circular plate and a middle section to serve as a location where said arcuate-shaped fin is substantially bent inward toward said circular plate, with said top end being positioned more inward than said opposing end, said rotating means further comprising a mounting disk fixedly attached to said circular plate and having a receiving or swivel loop centrally mounted thereto for engaging a hook attached to a second end of a common linear support emanating from said dome-shaped cover and a plurality of horizontal fins having a tail end connected to an exterior surface of the bottom ring and a free end.

11. A compact multipurpose cooking apparatus as set forth in claim 1, wherein said dome-shaped cover further comprises adjusting means for raising and lower of a cooking surface relative to a heat source.

12. A compact multipurpose cooking apparatus as set forth in claim 11, wherein said adjusting means comprises an elongate handle fixedly mounted to the apex of said dome-shaped cover and an aperture extending therethrough, substantially at the center of said dome-shaped cover for passage of a common linear support having first and second ends, said handle comprising an oval-shaped bore extending perpendicular to the longitudinal axis of said handle and a plate being positioned at an incline and lengthwise within said handle, said plate having a triangular-shaped aperture extending therethrough for passage of said first end of said common linear support, said triangular-shaped aperture comprising narrow and larger portions, wherein said narrow portion restricts or locks said first end to inhibit vertical movement of said common linear support, while said larger portion permits vertical passage of said first end for upward and downward adjustment of said cooking surface relative to the heat source.

13. A compact multipurpose cooking apparatus as set forth in claim 1, wherein said dome-shaped cover comprises latching means for securing said basin to said dome-shaped cover or attaching said basin to said suspending means to effectively protect the heat source during inclement climatic conditions.

14. A compact multipurpose cooking apparatus as set forth in claim 13, wherein said latching means comprises at least a pair of securing brackets diametrically located from one another and each having terminal ends fitted within a pair of tubular members located along an outer leading edge of said flange for pivotal engagement with a receiving hook in proximity to said securing brackets.

15. A compact multipurpose cooking apparatus as set forth in claim 1, wherein said flange of said basin further comprises a corresponding number of tapered sleeves engagingly fitted within each of said apertures of said flange to effectively serve as a guide to align said apertures of said flange with said cylindrical fittings of said annular ring, while said rim of said dome-shaped cover further comprises a corresponding number of tapered sleeves engagingly fitted within each of said apertures of said rim to effectively serve as a guide to align said apertures of said rim with said cylindrical sleeves of said annular ring and said tapered sleeves fitted to said flange.

16. A compact multipurpose cooking apparatus for use in outdoor environments, comprising, in combination:

an annular ring having at least three apertures extending therethrough, equidistant from one another;

a basin having a flange extending outwardly therefrom and a cooking surface fitted therewithin for supporting food and the like and a grate for supporting wood and charcoal, said flange having a geometric configuration corresponding to said annular ring and comprising at least three apertures extending therethrough for receiving a corresponding number of tapered sleeves engagingly fitted therewithin to effectively serve as a guide to align said apertures of said flange with those of said annular ring, said cooking surface comprising an upwardly extending outer wall along the periphery thereof to serve as a location for attaching at least three linear members using a corresponding number of S-hooks fitted thereto for suspension of said cooking surface above a heat source;

at least three legs for supporting said basin and said annular ring in an elevated position, each having an upper, middle and lower sections geometrically capable of being slidably fitted within one another for adjustment above the heat source and locked in placed by releasable locking means, said legs being fixedly connected to said annular ring at locations of the aligned apertures of said flange and said annular ring using a corresponding number of cylindrical fittings engagingly fitted into said apertures of said annular ring;

a dome-shaped cover having adjusting means for raising and lower of a cooking surface relative to a heat source and a rim extending outwardly therefrom, said rim having a geometric configuration corresponding to said flange of said basin and said annular rim and comprising at least three apertures extending therethrough for receiving a corresponding number of tapered sleeves engagingly fitted therewithin to effectively serve as a guide to align said apertures of said rim with said cylindrical fittings of said annular ring and said tapered sleeves fitted to said flange, wherein the aligned apertures of said annular ring, said flange, and said rim, collectively in alignment with each of said legs, effectively serve to channelize and drain accumulated water from said dome-shaped cover for protected accessibility to a heat source during inclement climatic conditions;

a turbine for turning the cooking surface about and above a heat source to uniformly heat foods and the like residing thereon, said turbine being substantially positioned above and near said cooking surface and below said dome-shaped cover and comprising a plurality of arcuate-shaped fins having a top end fixedly attached to a circular plate in an angular fashion, an opposing end fixedly attached to a bottom ring having a diameter larger than the diameter of said circular plate and a middle section to serve as a location where said arcuate-shaped fin is substantially bent inward toward said circular plate, with said top end being positioned more inward than said opposing end, said turbine further comprising a mounting disk fixedly attached to said circular plate and having a receiving or swivel loop centrally mounted thereto for engaging a common hook attached to a second end of a common linear support emanating from said dome-shaped cover and a plurality of horizontal fins having a tail end connected to an exterior surface of the bottom ring and a free end.

17. A compact multipurpose cooking apparatus as set forth in claim 16, wherein said releasable locking means comprises a plurality of spring biasing locking clips each substantially resembling a U-shape having terminal ends with apertures extending therethrough for receiving a ball of greater diameter than the diameter of said aperture, each of said middle and lower sections further comprising top ends each having a pair of diametrically opposed apertures extending therethrough for receiving a portion of said ball fitted within each of said apertures located at terminal ends of said locking clip, said upper and middle sections further comprising bottom ends having a plurality of bores extending therethrough for receiving a portion of said ball to lock said top ends of middle and lower sections with said bottom ends of said upper and middle sections, respectively, each of said locking clips being positioned and housed in each of said top ends of middle and lower sections.

18. A compact multipurpose cooking apparatus as set forth in claim 16, wherein said adjusting means comprises an elongate handle fixedly mounted to the apex of said dome-shaped cover and an aperture extending therethrough, substantially at the center of said dome-shaped cover for passage of said common linear support having a first end, said handle comprising an oval-shaped bore extending perpendicular to the longitudinal axis of said handle and a plate being positioned at an incline and lengthwise within said handle, said plate having a triangular-shaped aperture extending therethrough for passage of said first end of said common linear support, said triangular-shaped aperture comprising narrow and larger portions, wherein said narrow portion restricts or locks said first end to inhibit vertical movement of said common linear support, while said larger portion permits vertical passage of said first end for upward and downward adjustment of said cooking surface relative to the heat source.

19. A method of cooking foods and the like in an outdoor environment during inclement climatic conditions, comprising, in combination:

providing an annular ring for supporting a basin having a flange extending outwardly therefrom and a cooking surface fitted therewithin for supporting food and the like and a grate fitted therewithin for supporting wood and charcoal, said annular ring comprising at least three apertures extending therethrough, equidistant from one another, for receiving a corresponding number of cylindrical fittings engagingly fitted therewithin, said flange having a geometric configuration corresponding to said annular ring and comprising at least three apertures extending therethrough for receiving a corresponding number of tapered sleeves engagingly fitted therewithin to effectively serve as a guide to align said apertures of said flange with those of said annular ring, said cooking surface comprising an upwardly extending outer wall along the periphery thereof to serve as a location for attaching at least three linear members using a corresponding number of S-hooks fitted thereto for suspension of said cooking surface above a heat source;

fitting at least three legs to said annular ring using said cylindrical fittings engagingly fitted into said apertures of said annular ring, each of said legs having an upper, middle and lower sections geometrically capable of being slidably fitted within one another for adjustment above the heat source and locked in placed by releasable locking means;

positioning a dome-shaped cover over said basin, said dome-shaped cover having a rim extending outwardly therefrom, with said rim being geometrically configured to correspond with the geometric configuration of said flange of said basin and said annular rim and comprising at least three apertures extending therethrough for receiving a corresponding number of tapered sleeves engagingly fitted therewithin to effectively serve as a guide to align said apertures of said rim with said cylindrical fittings of said annular ring and said tapered sleeves fitted to said flange, wherein the aligned apertures of said annular ring, said flange, and said rim, collectively in alignment with each of said legs, effectively serve to channelize and drain accumulated water from said dome-shaped cover for protected accessibility to a heat source during inclement climatic conditions;

connecting a turbine to said dome-shaped cover using a common linear support having first and second ends and made adjustable through use of adjusting means, said turbine being substantially positioned above and near said cooking surface and below said dome-shaped cover and comprising a plurality of arcuate-shaped fins having a top end fixedly attached to a circular plate in an angular fashion, an opposing end fixedly attached to a bottom ring having a diameter larger than the diameter of said circular plate and a middle section to serve as a location where said arcuate-shaped fin is substantially bent inward toward said circular plate, with said top end being positioned more inward than said opposing end, said turbine further comprising a mounting disk fixedly attached to said circular plate and having a receiving or swivel loop centrally mounted thereto for engaging a hook attached to said second end of said common linear support emanating from said dome-shaped cover.

20. A method of cooking foods and the like in an outdoor environment during inclement climatic conditions as set forth in claim 19, wherein said releasable locking means comprises a plurality of spring biasing locking clips each substantially resembling a U-shape having terminal ends with apertures extending therethrough for receiving a ball of greater diameter than the diameter of said aperture, each of said middle and lower sections further comprising top ends each having a pair of diametrically opposed apertures extending therethrough for receiving a portion of said ball fitted within each of said apertures located at terminal ends of said locking clip, said upper and middle sections further comprising bottom ends having a plurality of bores extending therethrough for receiving a portion of said ball to lock said top ends of middle and lower sections with said bottom ends of said upper and middle sections, respectively, each of said locking clips being positioned and housed in each of said top ends of middle and lower sections.

21. A method of cooking foods and the like in an outdoor environment during inclement climatic conditions as set forth in claim 19, wherein said adjusting means comprises an elongate handle fixedly mounted to the apex of said dome-shaped cover and an aperture extending therethrough, substantially at the center of said dome-shaped cover for passage of said common linear support having a first end, said handle comprising an oval-shaped bore extending perpendicular to the longitudinal axis of said handle and a plate being positioned at an incline and lengthwise within said handle, said plate having a triangular-shaped aperture extending therethrough for passage of said first end of said common linear support, said triangular-shaped aperture comprising narrow and larger portions, wherein said narrow portion restricts or locks said first end to inhibit vertical movement of said common linear support, while said larger portion permits vertical passage of said first end for upward and downward adjustment of said cooking surface relative to the heat source.

22. A method of cooking foods and the like in outdoor environments during inclement climatic conditions as set forth in claim 19, further comprising attaching to said dome-shaped cover at least a pair of securing brackets diametrically located from one another and each having terminal ends fitted within a pair of tubular members located along a leading edge of said flange for pivotal engagement with a receiving hook in proximity to said securing brackets for securing said basin to said dome-shaped cover for storage and transport.

* * * * *